US006105976A

United States Patent [19]

Cottle

[11] Patent Number: 6,105,976

[45] **Date of Patent: *Aug. 22, 2000**

[54] QUICK RELEASE AXLE FOR IN-LINE SKATE BRAKE

[76] Inventor: Stefan Tyson Cottle, 6910 Jefferson Ave., Falls Church, Va. 22042

[ * ] Notice: This patent is subject to a terminal disclaimer.

[21] Appl. No.: 09/113,189

[22] Filed: Jul. 10, 1998

Related U.S. Application Data

[60] Provisional application No. 60/052,193, Jul. 10, 1997.

[51] Int. Cl.[7] ..... A63C 17/26

[52] U.S. Cl. ..... 280/11.2; 280/11.22; 280/11.27; 280/11.19

[58] Field of Search ..... 280/11.19, 11.2, 280/11.22, 11.27

[56] References Cited

U.S. PATENT DOCUMENTS

| | | | |
|---|---|---|---|
| 5,375,859 | 12/1994 | Peck et al. | 280/11.2 |
| 5,401,038 | 3/1995 | Peck et al. | 280/11.2 |
| 5,421,596 | 6/1995 | Lee | 280/11.19 |
| 5,704,618 | 1/1998 | Sfoggia | 280/11.2 |
| 5,769,432 | 6/1998 | Tybinkowski et al. | 280/11.2 |
| 5,915,703 | 6/1999 | Wrike | 280/11.22 |
| 5,941,539 | 8/1999 | Pratt | 20/11.27 |
| 5,964,537 | 10/1999 | Hill, Jr. | 384/559 |
| 5,988,656 | 11/1999 | Krah | 280/11.27 |

*Primary Examiner*—J. J. Swann
*Assistant Examiner*—L. Lum
*Attorney, Agent, or Firm*—Hoffman, Wasson & Gitler

[57] ABSTRACT

A quick-release axle system for in-line skates employing a disc-braking system providing easy removal of the braking wheel and brake system components for replacement or servicing. Two outer axles located on each side of a wheel provide support and activating means for the components of a disc-braking system. A central axle passing through the outer axles supports the braking wheel, allowing the wheel to rotate freely. Wheel removal is performed by removing the central axle from the outer axles, thus freeing the wheel. The outer axles, carrying components of the disc-braking device, remain attached to the skate frame. Removal of a retainer located on each of the outer axles, allows easy removal of the components of the disc-braking device attached thereto.

19 Claims, 5 Drawing Sheets

1
1
3
4
5
6
8
15
16
33
34D
37
38
39
40
41
42
43
44
45
46
47
48
49
53
57
58
59
61
62
63
64
65
66
67
2
10
11
12
13
14
17

QUICK RELEASE AXLE FOR IN-LINE SKATE BRAKE

This application claims benefit of Provisional application Ser. No. 60/052,193 filed Jul. 10, 1997.

BACKGROUND OF THE INVENTION

The present invention relates to an axle system particularly usable for skates, and especially for skates employing a disc-braking system.

Currently, in known roller skates employing a disc-braking system, the axles have a complex shape in order to both support the braking wheel and carry the components of the disc-braking system (U.S. Pat. Nos. 5,375,859, 5,401,038, 5,752,707). The axle sections adjacent to the wheel are shaped specifically to provide proper interaction of the braking system with the axles, effecting braking action on the wheel when so desired. Cylindrical portions of the axles, sized to standard wheel bearing inner diameters, pass through the wheel for support thereof.

When removal of the braking wheel is desired, these axle sections are unfastened and removed from the skate frame, allowing the wheel to be freed. However, all the disc-brake system components supported on the axles must also be removed from the axles to allow complete disassembly of the axles for wheel removal. This results in a complex, and potentially difficult, sequence of assembly steps just to replace the wheel. Parts may be lost or re-assembled incorrectly, resulting in frustrations to the user.

SUMMARY OF THE INVENTION

The design herein provides for easy removal of the braking wheel and brake components of an in-line skate disc-braking system. It allows for removal of the braking wheel, for replacement or service, without requiring complete disassembly of the axle from the skate frame. An easily removable central axle provides the primary support for the braking wheel. Since the outer axles carry the components of the disc-braking system, the design eliminates the problem of having these parts become disassembled when the braking wheel is removed. It does allow easy replacement of the disc-braking system components by removing a retainer from the outer axle half being serviced, without the need to disassemble the outer axles from the skate frame.

The design consists of an in-line roller skate, equipped with a boot, a frame, a plurality of wheels, and a disc-braking system. The design further consists of two outer axles attached to the frame, which each carry a brake disc, a lever arm, and a spring, which are components of a disc-braking system. A central axle passes through the outer axles to support the braking wheel. The outer axles have cylindrical and non-cylindrical sections for proper interaction with a disc-braking system. The central axle is removed to service the braking wheel while the outer axles remain fixed to the frame. Removal of a retainer on the outer axles allows for servicing of the components of the disc-braking system.

BRIEF DESCRIPTION OF THE DRAWINGS

The features and characteristics of the invention will be described with reference to the accompanying drawings in which.

DETAILED DESCRIPTION OF THE PREFERRED EMBODIMENTS

Figure 1:
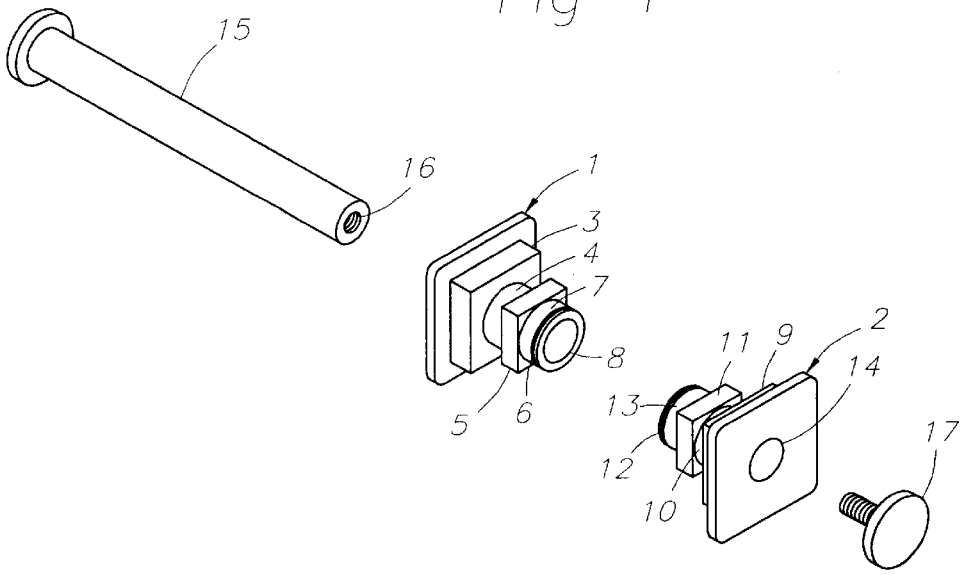
FIG. 1 is an exploded perspective view of the main components of the embodiment.
Figure 3:
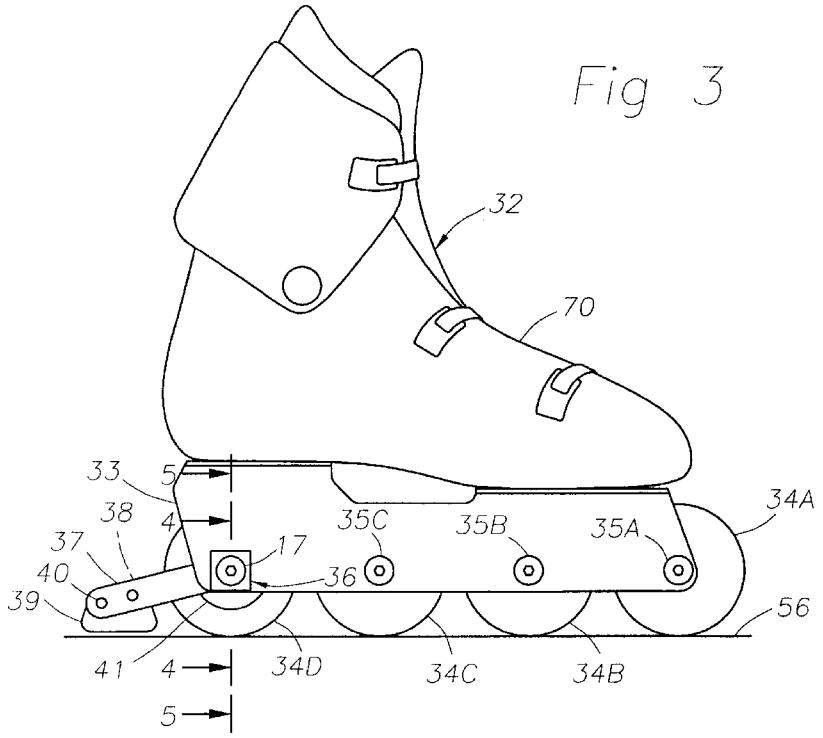
FIG. 3 is a side view of a skate embodying the invention in the normal skating position.

Referring to FIG. 1 and FIG. 3, there are shown left and right axle halves 1 and 2, which include keying portions 3 and 9, circular portions 4, 7, 13, and 10, and noncircular portions 5 and 11. Circumferential grooves 6 and 12 are located on circular portions 7 and 13. Clearance holes 8 and 14 passing through the center of axle halves 1 and 2 are provided to allow insertion of central axle 15 through both axle halves 1 and 2. An axle fastener 17 secures the axle assembly 36 by installing into threaded portion 16 of central axle 15. The axle assembly 36 comprises the means for mechanical support of a disc braking mechanism as well as the means for easy replacement of braking wheel 34D and brake components as described herein.

Figure 2:
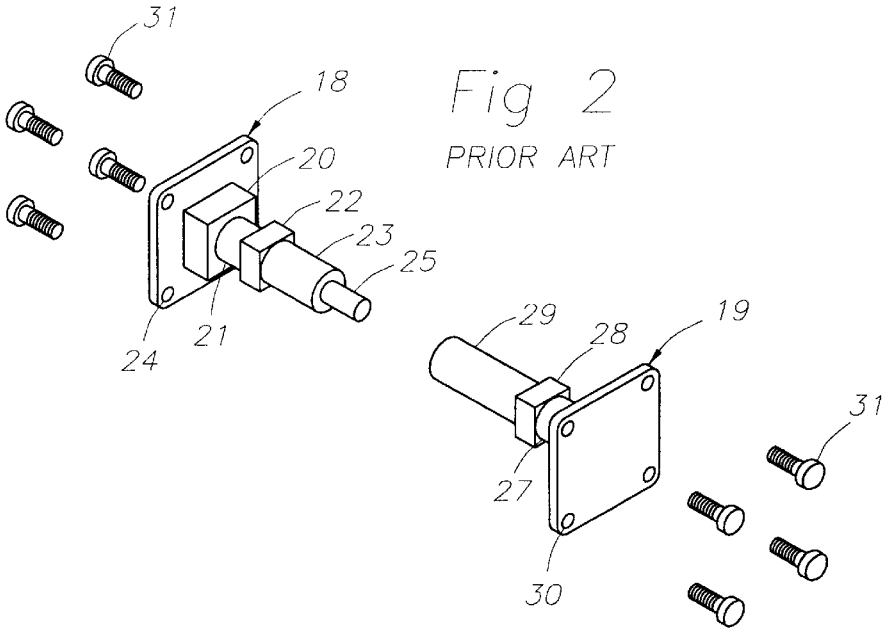
Fig 2 PRIOR ART
FIG. 2 is an exploded perspective view of a prior art axle for comparison purposes.

Referring to FIG. 2, there are shown prior art left and right axle halves 18 and 19, which include keying portions 20, circular portions 21, 23, 27, and 29, and non-circular portions 22 and 28. Alignment pin 25 inserts into right axle half 19 and provides rigidity to the axle assembly. Mounting bolts 31 pass through mounting holes 24 and 30 to fasten the left and right axle halves 18 and 19 to a skate frame 33.

Figure 4:
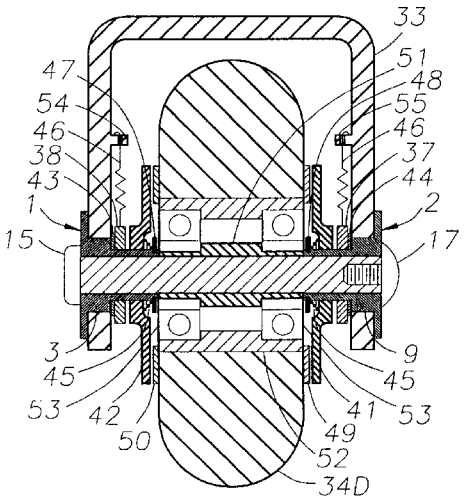
FIG. 4 is a partial cross sectional rear view of a braking wheel with the two disc brake embodiment of the invention in the normal skating position, taken in the direction of cutting plane 4—4 of FIG. 3.
Figure 9:
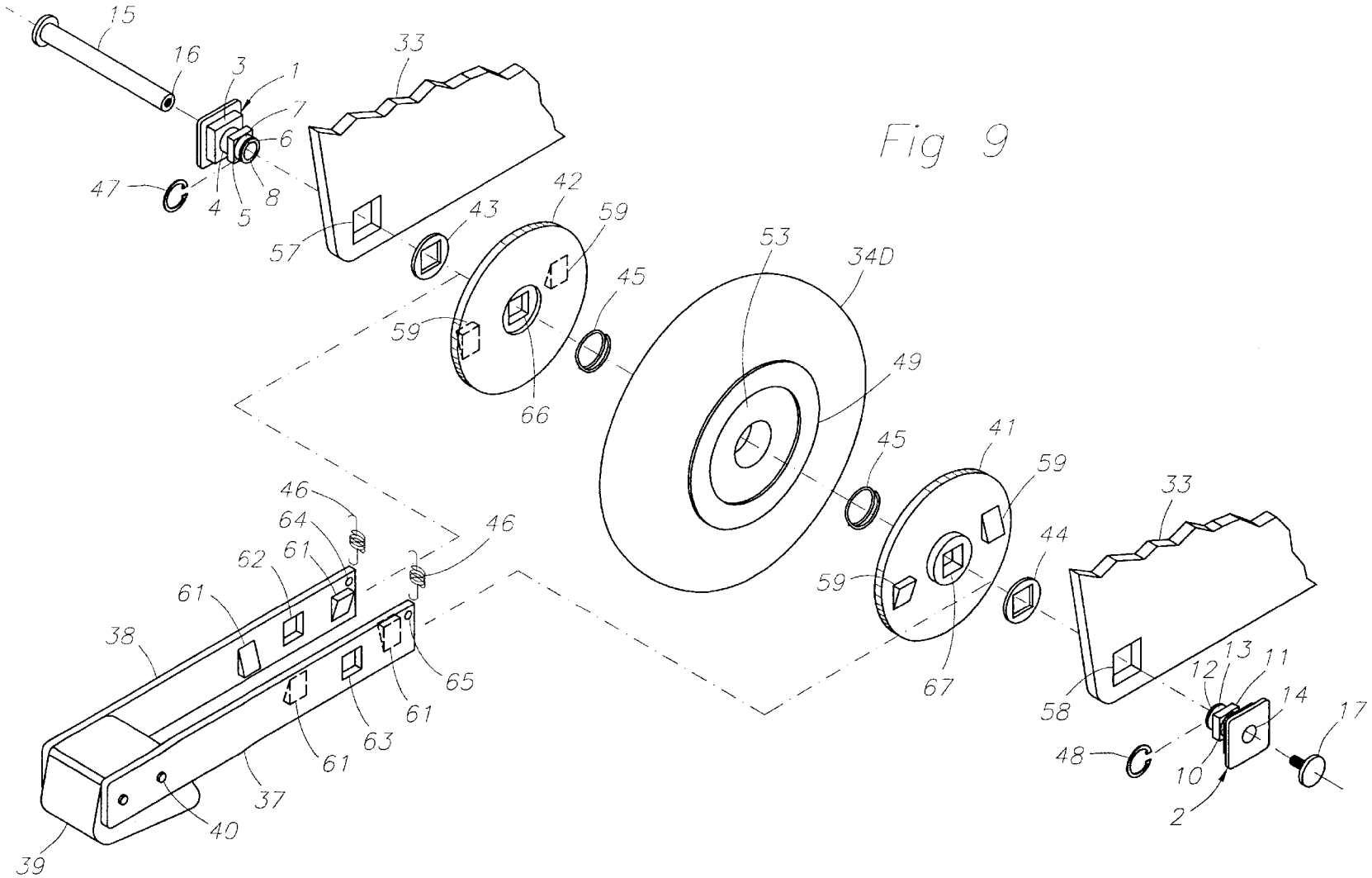
FIG. 9 is an exploded perspective view of the components of the two-disc skate brake embodiment.

Referring now to FIG. 3, FIG. 4, and FIG. 9, there is shown an in-line roller skate, 32, which includes a shell 70, and a skate frame which supports a plurality of wheels, here shown as wheels 34A, 34B, 34C, and 34D. The wheels are rotatably mounted to the skate frame 33 by means of axles 35A, 35B, and central axle 17.

The braking wheel 34D, which is in the rearmost location in this embodiment, is mounted to the rear of the frame 33 by means of the central axle 15. This central axle is positioned inside clearance holes 8 and 14 of axle halves 1 and 2, and is secured to the frame 33 by installing and tightening the axle fastener 17. Axle halves 1 and 2 are located in the frame 33 by seating keying portions 3 and 9 into cutouts 57 and 58, and are secured to the frame by the clamping forces of the assembled central axle 15 and the axle fastener 17.

The braking wheel is mounted to the central axle by means of integral bearings 53, which fit between an axle bushing 51 and the wheel hub 52. Two brake discs 41 and 42 are mounted to the non-circular axle portions 5 and 11. These non-circular axle portions are shown having a generally rectangular cross-section. However, a triangular or other non-circular shaped cross-section is within the purview of the invention. The brake discs have cutouts 66 and 67 that fit over the non-circular axle portions 5 and 11, allowing the disc brakes 41 and 42 to slide axially along the axle halves. Brake pads 49 and 50, integral to braking wheel 34D, form annular rings concentric with the central axis of the wheel.

Springs 45 are mounted between the brake discs 41 and 42 and retainers 47 and 48. The springs provide a means for applying force to the brake discs, preventing the brake disc surfaces and the brake pads 49 and 50 from contacting each other during normal skating. The retainers 47 and 48 are located in circumferential grooves 6 and 12 allowing the springs 45 and brake discs 41 and 42 to remain with the axle assembly 36 after the central axle 15 and the braking wheel 34D have been removed. Lever arms 37 and 38 are mounted to the circular axle portions 4 and 10. The lever arms have non-circular cutouts 62 and 63 that match and fit over non-circular axle portions 5 and 11. The cutouts are provided for assembly purposes, so the lever arms 37 and 38 may slide over the non-circular axle portions 5 and 11 and be properly positioned on circular axle portions 5 and 11. Springs 46 attach to lever arm cutouts 64 and 65 and frame tabs 54 and 55, providing lever arm tension during normal skating.

Lever arm ramp surfaces 61 located on either side of lever cutouts 62 and 63 contact mating ramp surfaces 59 on the brake discs 41 and 42 during brake engagement. A bearing surface 39 located at the rear of lever arms 37 and 38 is attached thereto by means of fasteners 40. Washers 43 and 44 provide a wear-resistant surface against which lever arms 37 and 38 may bear during braking.

Figure 6:
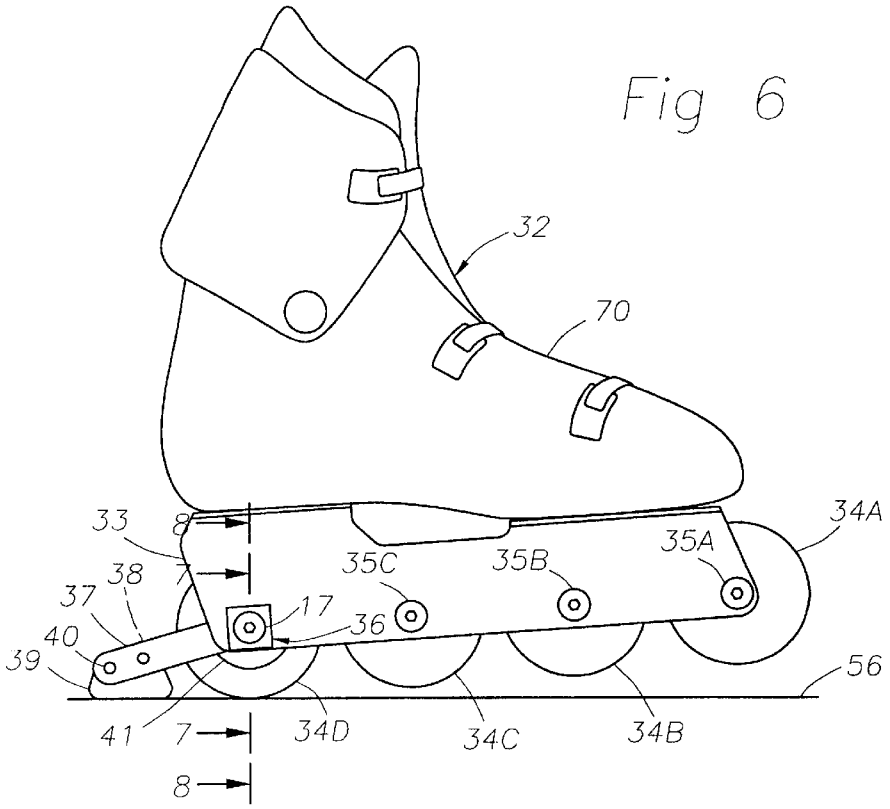
FIG. 6 is a side view of a skate embodying the invention, similar to FIG. 4, only showing the brake mechanism in the braking position.
Figure 7:
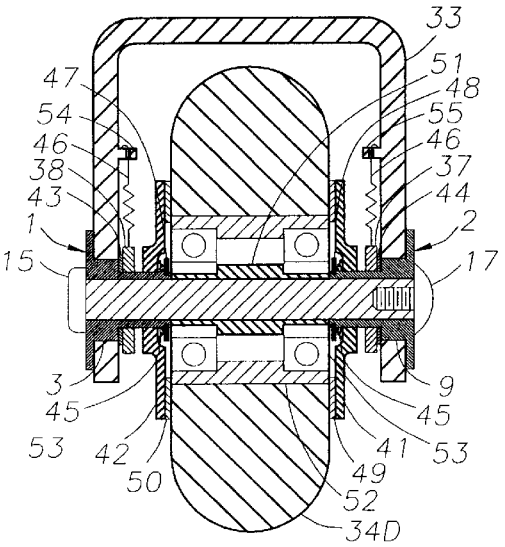
FIG. 7 is a partial cross sectional rear view of a braking wheel with the two disc brake embodiment of the invention in the braking position and the brake mechanism engaged, taken in the direction of cutting plane 7—7 of FIG. 6.

The function of the axle assembly in the aforementioned embodiment of the invention is as follows. Referring to FIGS. 6–7, when the skater desires braking, the skater rotates the skate 32 rearward about the rear wheel 34D, lever arms 37 and 38 are urged to the ground 56. Bearing surface 39 contacts the ground causing clockwise rotation of lever arms 37 and 38 about circular axle portions 4 and 10. The rotation of the lever arms causes the lever arm ramp surfaces 61 to engage the brake disc ramp surfaces 59. This contact causes the brake discs 41 and 42 to slide laterally along the non-circular axle portions 5 and 11 toward the brake pads 49 and 50.

The moment generated in the brake discs 41 and 42 by the lever arms 37 and 38 during braking is transferred to the non-circular axle portions 5 and 11. The moment is further be transmitted through the axle halves 1 and 2 to the skate frame 33. Axle keying portions 3 and 9 are seated snugly into frame cutouts 57 and 58 allowing the skate frame to absorb the moment and prevent the axle halves 1 and 2 from rotating.

The friction between the brake discs 41 and 42 and the brake pads 49 and 50 causes the rotation of the braking wheel 34D to slow or stop, which will slow or stop the skater. Referring now to FIGS. 3 and 4, when the skater wishes to resume normal skating, the skater lowers the toe of the skate which lifts the bearing surface 39 off the ground 56. This results in counter-clockwise rotation of the lever arms 37 and 38 allowing ramps 59 and 61 to disengage. The outward force imparted by springs 45 pushes the brake discs 41 and 42 away from the brake pads 49 and 50, allowing the braking wheel 34D to rotate freely.

Alternatively, it may be advantageous to provide braking with only one brake disc, which would provide sufficient braking force, yet reduce manufacturing costs for supply as a more economical embodiment.

Figure 5:
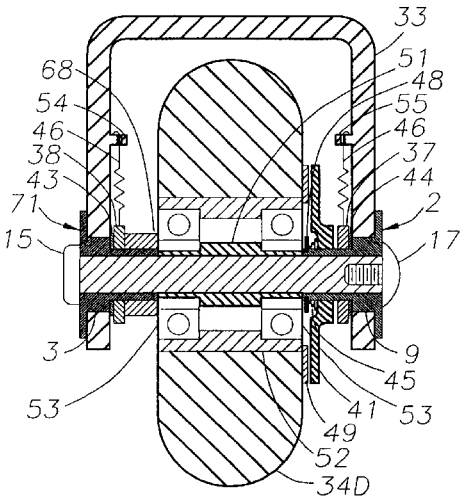
FIG. 5 is a partial cross sectional rear view of a braking wheel with the single disc brake embodiment of the invention in the normal skating position, taken in the direction of cutting plane 5—5 of FIG. 3.
Figure 8:
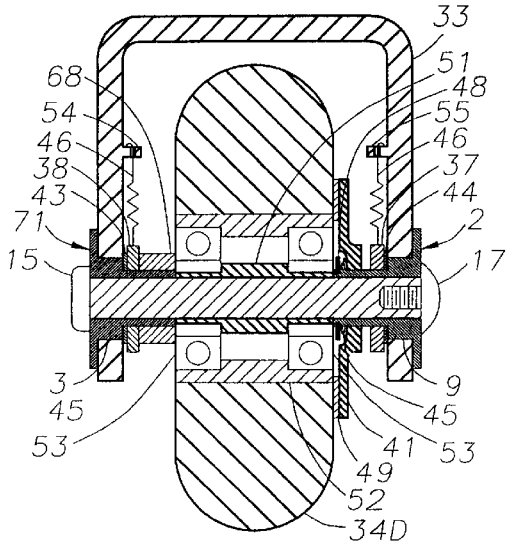
FIG. 8 is a partial cross sectional rear view of a braking wheel with the single disc brake embodiment of the invention in the braking position and the brake mechanism engaged, taken in the direction of cutting plane 8—8 of FIG. 6.
Figure 10:
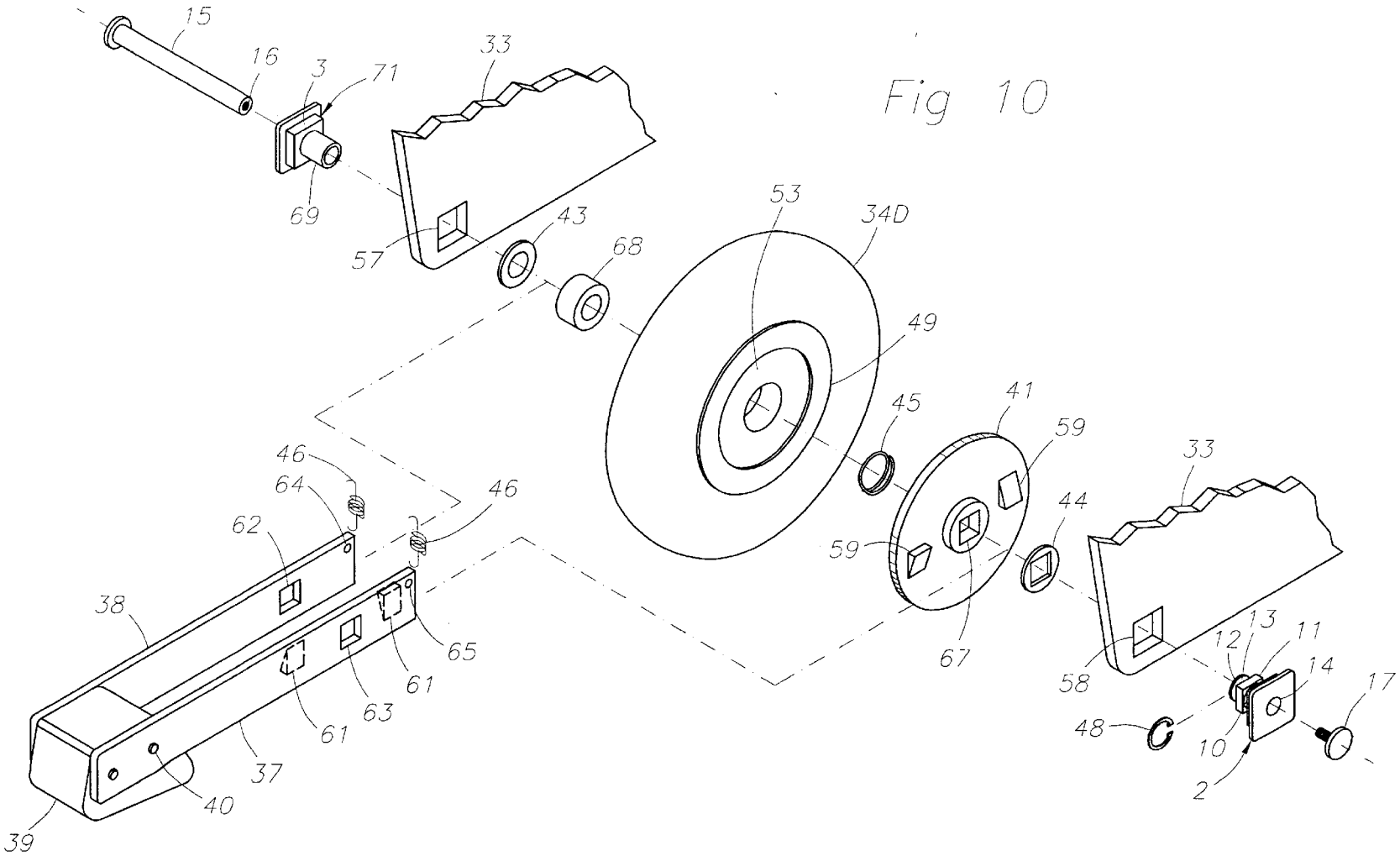
FIG. 10 is an exploded perspective view, similar to FIG. 9, of the components of the single-disc skate brake embodiment.

FIGS. 5 and 10 illustrate this further embodiment of the invention where the wheel brake assembly comprises one brake disc 41. A spacer 68 provides proper lateral alignment of brake lever 38 mounted to circular axle portion 69 of a simplified axle half 71. FIG. 8 illustrates the single brake disc embodiment during brake engagement.

Referring to FIG. 4 and FIG. 9, when it is desired to replace the braking wheel 34D or any other components of the brake assembly, fastener 17 is removed and central axle 15 is extracted from the axle assembly 36. The skate frame 33 is molded to spring outward slightly when central axle 15 is extracted. This allows the braking wheel 34D with brake pad surfaces 49 and 50 to be removed by sliding wheel 34D out between axle halves 1 and 2. Since retainers 47 and 48 remain fastened to the axle halves 1 and 2, all additional brake components remain captive to the skate. Braking wheel replacement can thereby be performed without concern for loss of brake parts.

The frame 33 may also be molded in such a fashion so as not to spring outward when central axle 15 is extracted. In this embodiment, wheel removal is effected by simply spreading the frame 33 slightly, allowing the braking wheel 34D to be removed.

When it is desired to replace brake discs 41 and 42, brake levers 37 and 38, or other brake assembly components, retainers 47 and 48 are removed after removal of the braking wheel 34D. This allows all remaining brake assembly components to be removed or replaced.

Re-assembly of brake components is performed by first replacing all removed components captive to the axle halves 1 and 2. Retainers 47 and 48 are then installed. Braking wheel 34D is installed by sliding it between axle halves 1 and 2, inserting central axle 15, and securing the central axle with fastener 17. It should be understood that the axle assembly 36 may be used with a disc braking mechanism located in any of the wheel positions 34A, 34B, 34C, and 34D. The axle assembly 36 is shown being used with a disc braking system activated by ground contact. It should be understood that the axle assembly 36 may be used with a disc braking system with the lever arms 37 and 38 engaged by cuff activation or other means.

What is claimed is:

1. An in-line roller skate disc brake axle system comprising:

a first outer axle and a second outer axle located on a central axis of a wheel, whereby said first and second outer axles are rigidly fastened to a frame on a roller skate to prevent rotation of said first and second outer axles relative to said frame;

a central inner axle positioned in and removable from said first and second outer axles passing along said central axis of said wheel.

2. The axle system of claim 1 wherein said first and second outer axles each have a cylindrical exterior section and a non-cylindrical exterior section for engagement with a disc-braking device.

3. The axle system of claim 2 wherein said cylindrical exterior section of said first and second outer axles has a groove formed thereon.

4. The axle system of claim 1 further comprising a retainer located on an exterior surface of said first and second outer axles for retention of a disc-braking device to each of said first and second outer axles.

5. The axle system of claim 4 wherein said retainer is a detachable retaining ring.

6. The axle system of claim 1 wherein said central inner axle has a cylindrical shape.

7. The axle system of claim 1 further comprising a fastening means for retaining said inner axle to said frame.

8. The axle system of claim 1 wherein said first and second outer axles have two cylindrical and two non-cylindrical exterior sections.

9. The axle system of claim 1 wherein said first outer axle has a cylindrical exterior section and said second outer axle has a cylindrical exterior section and a non-cylindrical exterior section for engagement with a single-disc braking device.

10. The axle system of claim 1 wherein said first and second outer axles further comprise an outer plate wherein said outer plate engages with said frame to aid in alignment and retention of said first and second outer axles with said frame.

11. An in-line roller skate disc brake axle system comprising:

first and second outer axles located on a central axis of a wheel, whereby said first and second outer axles are rigidly fastened to a frame on a roller skate to prevent rotation of said first and second outer axles relative to said frame;

a removable central inner axle, positioned on said central axis within said first and second outer axles;

said first and second outer axles each having a cylindrical exterior section and a non-cylindrical exterior section for engagement with a disc-braking device; and a retainer located on an exterior surface of said first and second outer axles for retention of a disc-braking device to each of said first and second outer axles.

12. The axle system of claim 11 wherein said retainer is a detachable retaining ring.

13. The axle system of claim 12 wherein said central inner axle has a cylindrical shape.

14. The axle system of claim 12 further comprising a fastening means for retaining said inner axle to said frame.

15. The axle system of claim 12 wherein said first and second outer axles each have two cylindrical and two non-cylindrical exterior sections.

16. The axle system of claim 12 wherein said first outer axle has a cylindrical exterior section and said second outer axle has a cylindrical exterior section and a non-cylindrical exterior section for engagement with a single-disc braking device.

17. The axle system of claim 12 wherein said first and second outer axles further comprise an outer plate wherein said outer plate engages with said frame to aid in alignment and retention of said first and second outer axles with said frame.

18. The axle system of claim 12 wherein said cylindrical exterior section of said first and second outer axles has a groove formed thereon.

19. An in-line roller skate disc brake axle system comprising:

first and second outer axles located on a central axis of a wheel, whereby said first and second outer axles are rigidly fastened to a frame on a roller skate to prevent rotation of said first and second outer axles relative to said frame; a removable central inner axle, positioned on said central axis within said first and second outer axles;

said first and second outer axles each having a cylindrical exterior section and a non-cylindrical exterior section for engagement with a disc-braking device;

a retainer located on an exterior surface of said first and second outer axles for retention of a disc-braking device to each of said first and second outer axles;

said retainer further being detachable;

said central inner axle having a cylindrical shape;

said central inner axle further having a fastening means for retaining said inner axle to said frame;

said first and second outer axles further having two cylindrical and two non-cylindrical exterior sections;

said first and second outer axles further having an outer plate wherein said outer plate engages with said frame to aid in alignment and retention of said first and second outer axles with said frame;

said cylindrical exterior section of said first and second outer axles further having a groove formed thereon.

* * * * *